US005997288A

United States Patent [19]

Adams

[11] Patent Number: 5,997,288

[45] Date of Patent: Dec. 7, 1999

[54] APPARATUS FOR THERMAL REMOVAL OF SURFACE AND INHERENT MOISTURE AND LIMITING REHYDRATION IN HIGH MOISTURE COALS

[75] Inventor: Robert J. Adams, 2364 Trimble Rd., Pittsburgh, Pa. 15237

[73] Assignee: Robert J. Adams, Pittsburgh, Pa.

[21] Appl. No.: 08/853,032

[22] Filed: Apr. 18, 1997

[51] Int. Cl.[6] ..... F27B 7/00; F27B 7/36; C10B 1/10

[52] U.S. Cl. ..... 432/105; 432/103; 432/107; 432/108; 432/110; 432/111; 432/112; 432/113; 432/117; 432/118; 34/108; 34/130; 34/131; 34/132; 202/105; 202/131; 110/226; 110/227; 110/229

[58] Field of Search ..... 110/115, 220, 110/224, 226, 246, 229; 432/103, 110, 108, 105, 106, 107, 109, 111, 112, 113, 117, 118; 34/108, 109, 130, 131, 132, 134, 135, 137, 138, 139; 44/620, 621, 626, 629, 903, 905; 202/105, 108, 128, 129, 131, 151

[56] References Cited

U.S. PATENT DOCUMENTS

| | | | |
|---|---|---|---|
| Re. 33,776 | 12/1991 | Noland | 110/346 |
| 846,355 | 3/1907 | Slingsby . | |
| 942,692 | 12/1909 | Wingate | 34/109 |
| 1,061,762 | 5/1913 | Lierfeld | 34/109 |
| 2,043,459 | 6/1936 | Windecker . | |
| 2,122,037 | 6/1938 | Lissauer . | |
| 2,213,667 | 9/1940 | Dundas et al. . | |
| 2,653,393 | 9/1953 | Bojner | 34/137 |
| 2,810,968 | 10/1957 | Pitt | 34/109 |
| 2,933,306 | 4/1960 | Davis et al. . | |
| 3,251,137 | 5/1966 | Alleman | 34/139 |
| 3,410,233 | 11/1968 | Seiler | 110/220 |
| 3,982,052 | 9/1976 | Bearce . | |
| 4,361,100 | 11/1982 | Hinger | 110/238 |
| 4,451,231 | 5/1984 | Murray | 432/13 |
| 4,476,790 | 10/1984 | Borio et al. | 110/245 |
| 5,197,204 | 3/1993 | Christensen | 34/135 |
| 5,305,533 | 4/1994 | Alexander et al. | 34/48 |
| 5,312,599 | 5/1994 | Schwartz, Jr. | 422/209 |
| 5,688,117 | 11/1997 | May et al. | 432/103 |
| 5,716,205 | 2/1998 | Tratz | 432/103 |
| 5,788,481 | 8/1998 | Von Beckmann | 432/103 |

FOREIGN PATENT DOCUMENTS

| | | | |
|---|---|---|---|
| 637204 | 4/1928 | France | 34/137 |
| 113297 | 9/1900 | Germany | 432/105 |
| 59-164818 | 9/1984 | Japan | 110/115 |
| 1 601 460 A2 | 10/1990 | U.S.S.R. | 110/115 |

*Primary Examiner*—Ira S. Lazarus
*Assistant Examiner*—Ljiljana V. Ciric

[57] ABSTRACT

A flighted, horizontally inclined rotary retort, heated externally by flame, hot gases, steam or other sources of heat. The retort shall have sufficient flight area to transport the coal through the retort in the predetermined time. The coal being processed in this retort is prevented from becoming exothermic by provision for a countercurrent flow of blanket gas, heated to a predetermined temperature below exotherm, to prevent coal surface temperatures from rising above the ignition temperature. The retort accommodates oversize pieces of raw coal by having alternating long and short flights, thus allowing greater space between long flights and allowing the larger pieces to be carried over the center pipe by the wiping action of the long flights. The retort will also be provided with an internal pipe, mounted on the center line of the shell. This pipe will be provided with the means for installation of thermocouples at regular intervals thereon in order to measure the surface temperature of the fuel in process. The temperature signals received from the thermocouples are used to control the heating rate and/or feed rate of the coal, or the speed of rotation of the retort.

8 Claims, 3 Drawing Sheets

CROSS SECTION A-A OF FIGURE 1

APPARATUS FOR THERMAL REMOVAL OF SURFACE AND INHERENT MOISTURE AND LIMITING REHYDRATION IN HIGH MOISTURE COALS

CROSS REFERENCES TO RELATED PATENTS (Issued to this Applicant)

METHOD FOR TREATING COAL—U.S. Pat. No. 5,254,139, issued Oct. 19, 1993 AN IMPROVED FUEL COAL—U.S. Pat. No. 5,468,265, issued Nov. 21, 1995.

BACKGROUND OF THE INVENTION

Applicant has obtained the above noted patents covering the process and product produced by the NU-FUEL process for the treatment of all ranks of coals to reduce surface and inherent moisture, limit moisture rehydration, reduce the tendency for spontaneous combustion and produce many other improved combustion characteristics. In my research into the production of this alternative fuel, I have determined that the available state-of-the-art flighted horizontal inclined rotary retort equipment is not sufficient to allow for the application of the process and for the production of the desired product.

BRIEF SUMMARY OF THE INVENTION

The object of this invention is to provide a flighted, horizontally inclined rotary retort, heated externally, with sufficient flight area to fulfill the requirements for heating the required volume of coal, passing through the retort at a predetermined average depth of raw fuel, on each flight once during each revolution.

It is another object of the invention to provide a method for accomplishing said heating from the outside by means of impinging either flame, hot gases, steam or other sources of heat to a limited area on the exterior portion of the shell.

It is still another object of the invention to provide for a countercurrent flow of blanket gas heated to a predetermined temperature below exotherm, or the ignition temperature, in order to control the surface temperature of the coal particles being processed in the retort to prevent the coal particles from reaching exotherm and also to carry moisture vapors removed from the fuel out of the retort.

It is a further object of the invention to provide a retort that has the means to accommodate oversize pieces of raw coal by having alternating long and short flights inside the retort and means for separation of the larger segments of coal by allowing smaller particles of coal to fall from the revolving flights directly to the bottom of the inclined shell while causing the larger particles to be carried over to the flights on the downward moving side. Thus, the smaller fractions contact the shell beyond the point of external heating, thereby witnessing lower temperatures and absorbing lesser-amounts of heat. The larger fractions are carried over a center pipe and then down, by the flights on the downward moving side of the shell, to the point of maximum heating, which is located in the ⅛ quadrant from the bottom center of the shell on the descending side. This provides the "shock" heating required to raise the temperature in the interstices of the larger pieces of coal and thereby vaporize the moisture therein.

It is a further object of the patent to provide a rotatable pipe on the center line of said retort in order to provide the means for installing thermocouples at regular intervals along said center pipe in order to measure the surface temperature of the coal at regular intervals while the coal is in process.

It is a further object of the invention to provide the center pipe with curved recesses on the top surface of the pipe offset some 5° to 10° toward the upward moving side of the shell. These curved recesses shall have state-of-the-art thermocouples attached thereto, thus allowing contact with the coal particles, collected in said recesses, in order to measure the surface temperature of the dried and/or treated coal coming into contact with said thermocouples as the coal is dropped from the rotating flights and/or is carried over said center pipe by the wiping action of the flights. Fuel in process, collected in the above noted recesses, shall be removed from said recesses, once each revolution of the shells by rotating the center pipe some 90° to 120° by hydraulic operators in a direction opposite to the retort rotation.

It is still another object of the invention to establish the ratio of the diameter of the interior pipe to the shell diameter, as well as the length of both the pipe and the shell, and the dimensions of the end boxes, gas piping and width of the various flights. These dimensions are determined by the volume of the raw coal to be processed, the degree of treatment required, the analysis of said coal and the maximum size of coal particles required to fall directly to the bottom of the shell. Also, it is necessary to establish the amount of moisture required to be removed from said coal in order to produce the desired alternative fuel.

It is still another object of the invention to provide for sending temperature signals from the above noted thermocouples to a computer programmed to adjust the rate of heat provided to the shell and/or the feed rate of raw fuel and/or the rotational speed of the retort in order to prevent the coal from reaching exotherm and to ensure that proper treatment temperatures are achieved.

I have found that heating of the external skin of the shell of a horizontally inclined, axially rotating cylindrical retort can best be accomplished by the impingement of flame and/or hot gases such as steam or those generated by burning pulverized coals natural gas, propane or other combustible gases in either gas burners, coal-fired slagging combustors or steam nozzles. The gases are directed to impinge on a predetermined limited area of the external portion of the shell. Other sources of heat may also be used such-as electrical heating rods.

I have further found that it is necessary to control both the rate of feed of coal to the retort and the rate of heating over each individual segment of the retort. Therefore, the temperature of said coal is measured at regular intervals along the path of the coal as it progresses through the retort. This is accomplished by supplying data from the thermocouples on the surface of the internal pipe as well as data relating to the weight of coal fed via a vibratory or other type feeder to a programmable logic computer (PLC) to maintain preprogrammed coal surface temperatures by controlling the feed rate of raw coal, or volume of fuel to the burners, or the rotative speed of the retort.

The aforementioned pipe is mounted on the center line of the shell of said retort. It shall be supported by hangers with solid lubricant contact surfaces, allowing said center pipe to remain stationary as the retort rotates. Said pipe allows for sensing points to be established at regular intervals in order obtain the surface temperatures of the coal particles in accordance with predetermined process levels.

In order to dry and treat coals by the NU-FUEL process, it is necessary to provide the means of causing the raw coal to witness a predetermined rate of heating, which rate must be variable as the fuel travels through the retort. The best way to assure that different heating rates can be maintained on the surface of the fuel in process is to provide the heat that must be absorbed into the coal particles in order to dry as well as cause the heat necessary for molecular transformation to be absorbed from the heated shell of said retort.

Therefore, I have determined that the retort will be a horizontally inclined, axially rotating unit. Said retort will obtain the heat to raise the temperature of the raw coal by impinging flames and/or hot gases, or other sources of heat, to the exterior of the shell of said retort means.

In order that the rate of heating can vary from "shock" heating in the initial portion of the drying section, to low-level heating to maintain a predetermined temperature of the coal during the treatment phase, it is necessary that each four-foot (4') section of the retort shell be provided with controls to automatically regulate the amount of heat applied, and/or the weight of coal feed, and/or the rotative speed of the retort.

In addition, other requirements are provided for as covered in the "Detailed Description of the Preferred Embodiments". These include, among others, the proper flow and temperature of the blanket gas, inlet end boxes with large enough dimensions to drop the velocity of the existing blanket gases in order to remove most of the fines carried by said blanket gases as well as provision for cooling the finished product prior to removal of same from the retort.

BRIEF DESCRIPTION OF THE SEVERAL VIEWS OF THE DRAWINGS

A full understanding of the construction of the retort can be gained from the description of the preferred embodiments when read in conjunction with the following drawings in which.

DETAILED DESCRIPTION OF THE INVENTION

Figure 1:
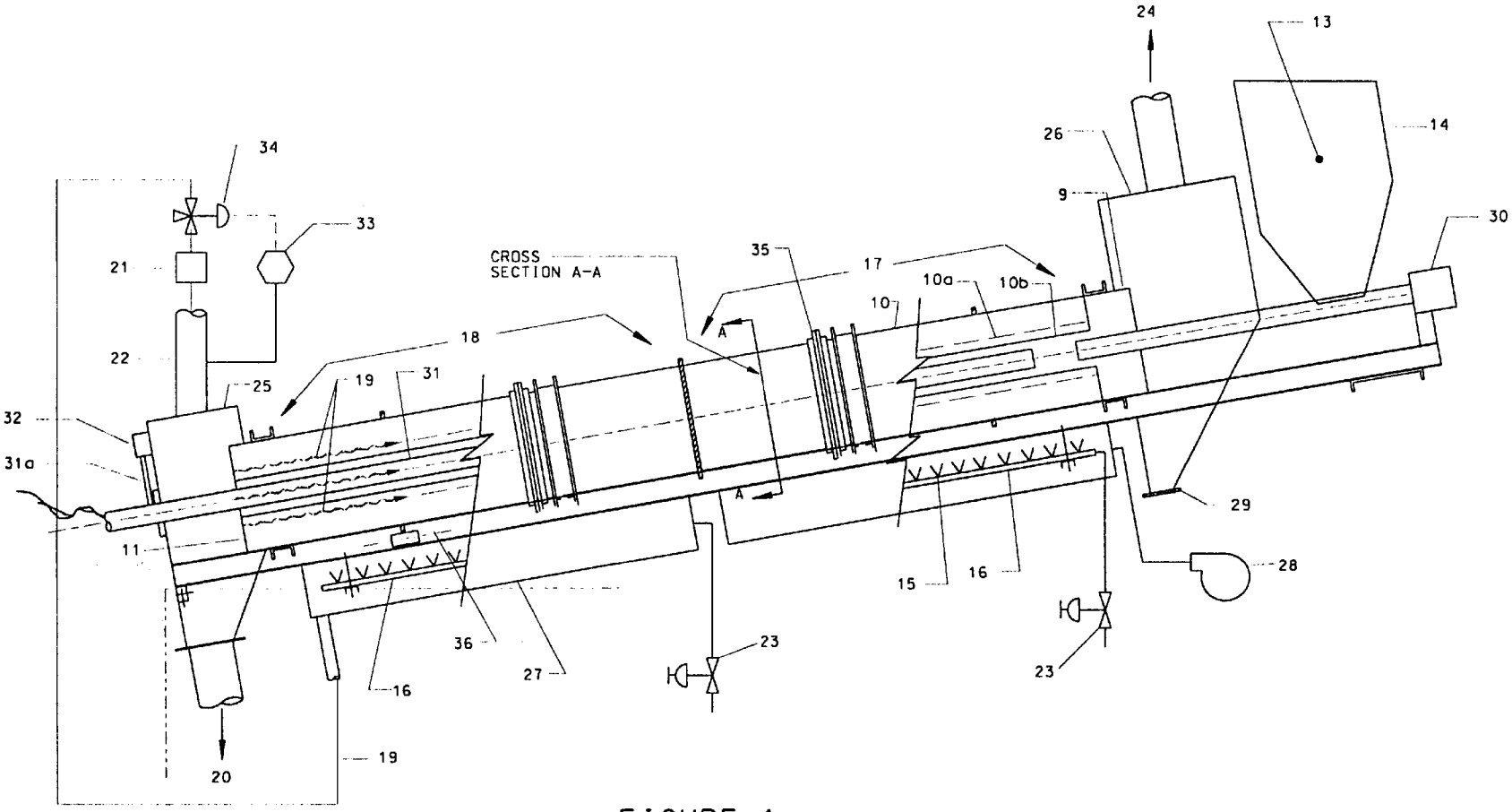
FIG. 1 is a schematic illustrations in partial cross section, illustrating the preferred configuration of the retort.

FIG. 1 illustrates schematically the type of retort necessary to carry out the preferred method for the treatment of coals by the NU-FUEL process. As illustrated, a flighted cylindrical retort shell 10 is inclined from the horizontal to provide for movement of the coal downward through said shell, As used herein, the term inclined with respect to retorts is intended to include those inclined at a slight angle as illustrated in FIG. 1, but not vertical retorts. The retort 10 has an inlet 9 and outlet generally 11 and end boxes 25 and 26, one at each end.

End box 25 is provided with an entry connection 22 for introduction of the blanket gas and a treated coal discharge 20 to a state-of-the-art rotary airlock or double dump valve. In addition, it is provided with an end plate with provision for entry of the center pipe 31. Also, provision is made for sealing material around said pipe to prevent air leakage around said center pipe as well as for an automatic means 32 of rotating the center pipe some 90° to 120° once each revolution in order to dump the collected samples of fuel used to obtain temperatures of same. End box 26 is provided with an exit connection 24 for the blanket gas and a connection 29 to a state-of-the-art rotary airlock for removal of fines carried out of said retort by said blanket gas. Also, end box 26 is provided with an end plate with provisions for connection with a vibratory or other type coal feeder 30 with a raw coal supply hopper 14. The blanket gas is also the vehicle used to carry the moisture vapors released by the coal from the retort shell 10 through end box 26 via connection 24.

The diameters of said shell 10 and center pipe 31 as well as the length of each and the dimensions of the end boxes 25 and 26, of the gas piping and of flights 10*a* and 10*b* are determined by the volume of raw coal particles 13 required to be treated, the type of said coal, and the degree of treatment to be provided in order to produce the desired alternative fuel.

As illustrated, the retort shell 10 is heated on the outside of its shell by external heating means such as flames 15 from gas fired burners 16. Gas or other fuel 23 is supplied to the burners 16. The oxygen content of the flue gas, produced by the burners and used as the blanket gas in the retort shell 10, is controlled by the oxygen monitoring device 33, with the computer adjusting the fuel flow control valves 34. Other heat sources may be used, such as hot flue gas and gas discharged from slagging combustors fired with coal and other fuels such as oil, treated or untreated coal, wood, etc., to provide the heat and/or flame 15 for externally heating the shell 10.

Figure 2:
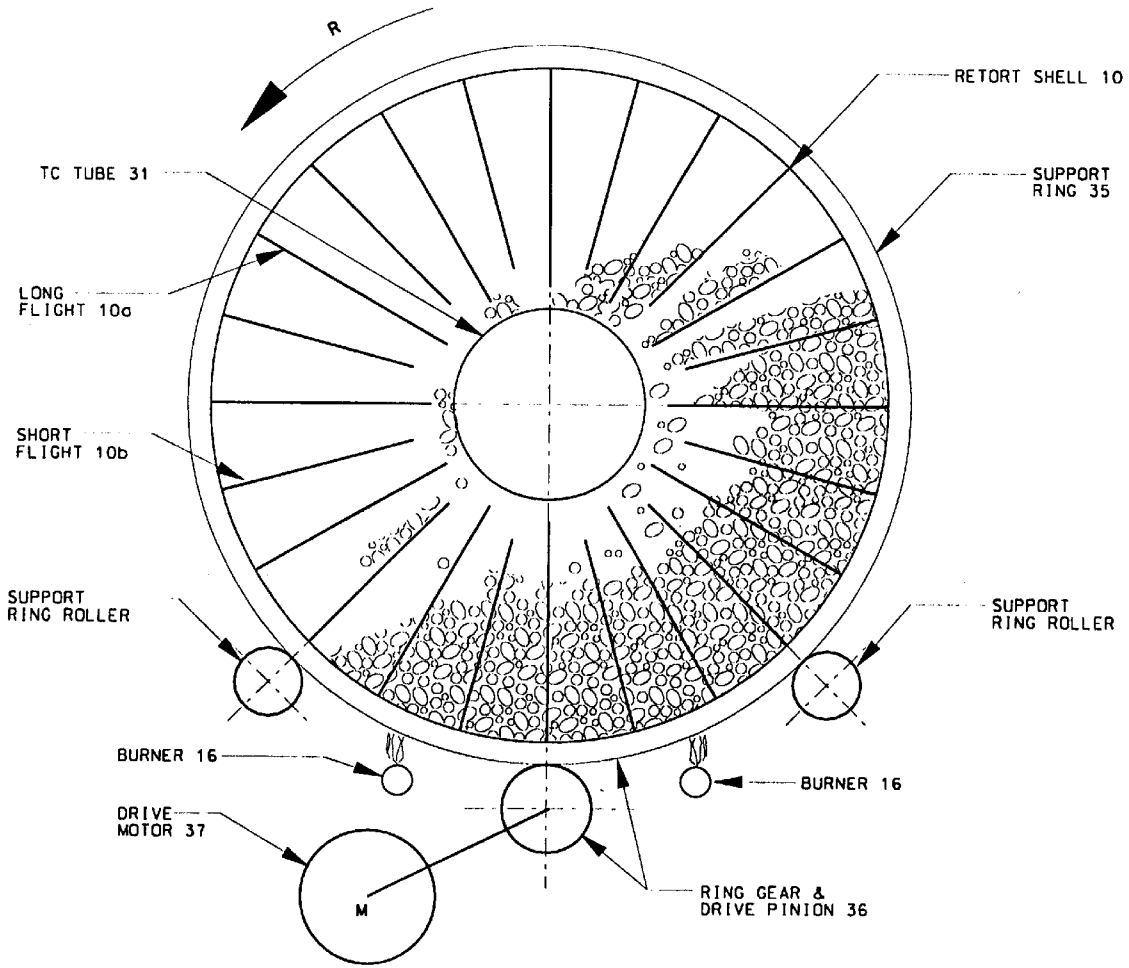
FIG. 2 is a cross sectional view taken generally along the lines A—A of FIG. 1.
Figure 3:
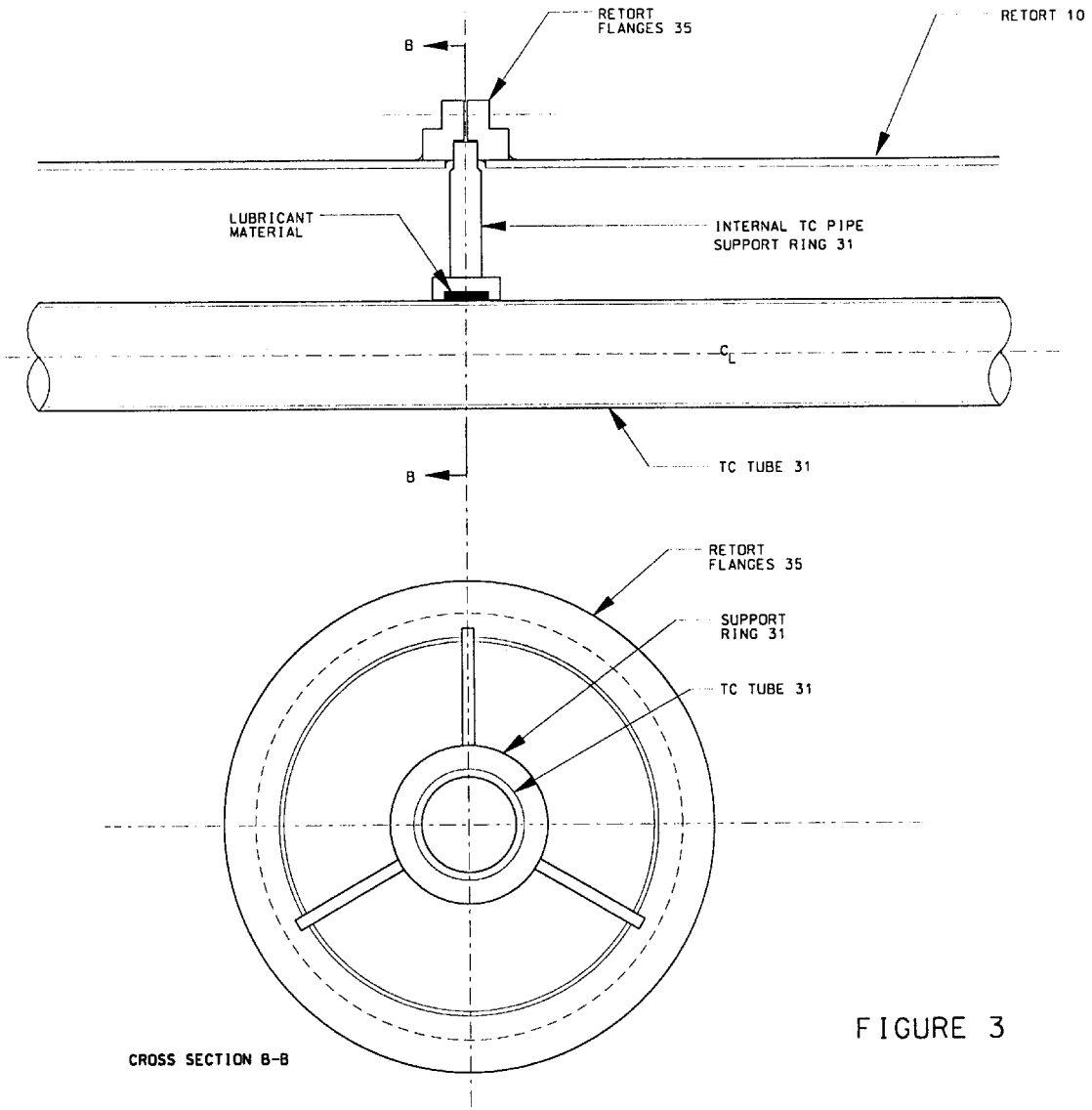
FIG. 3 is a detailed drawing of the means to support the center pipe inside the shell of the retort

As illustrated in FIG. 2, the retort shell 10 includes long flights 10*a* and short flights 10*b*, which are sized to transport the predetermined volume of coal 13 to be carried partially around the retort shell 10 as it rotates in the direction R. The short flights provide the space required to accommodate occasional oversized pieces of coal. The construction of the retort also allows for the blanket gas 19 to pass through the retort shell 10 to contact the coal particles 13 as they are discharged from the flights, thus maintaining the surface temperature of the coal being processed below exotherm. As shown, it is preferred that the lower ⅛ quadrant Q on the descending side of the shell be heated. This lower ⅛ quadrant coincides with the area of the rotating retort in which the larger pieces of the coal 13 tend to accumulate when the retort is rotated in the direction R as shown.

In general, support of the shell is accomplished by state-of-the-art roller units, one for each set of flanges connecting the sections of said shell 10. Contact between the rollers and shell 10 shall be on the outside edge of the flanges 35 connecting the sections of the shell plus the connecting flanges for the replaceable end fittings which carry the shell into the end boxes. Rotation is accomplished by providing sets of state-of-the-art ring gears and pinions 36, one for each retort section, all powered by a single state-of-the-art variable-speed electric motor 37 as controlled by a computer program.

When the raw coal 13 enters the heated retort shell 10 in the drying section 17, it immediately contacts the hot internal surface of the shell 10 and is shock heated. When substantially all of the moisture initially contained in the raw coal is driven off and carried by the blanket gas from the retort shell 10 out through the end box 26 and connection 24, the coal 13 passes through the retort shell 10 from the drying section 17 into the treating section 18, where the heating rate is gradually reduced to the levels predetermined for the treatment section.

The treating section 18 is also equipped with burners 16. As the shock heated coal dried in section 17 passes into the treating section 18, it continues to come into contact with the blanket gas 19. Following the treating of the coal, the treated coal 13 is recovered as illustrated.

As further illustrated in FIG. 1, it is preferred that the blanket gas be passed through the coal 13 in a direction countercurrent to the direction of the coal passing through the retort. The temperature of the blanket gas 19 is preferably controlled with a heat exchanger 21 capable of heating or cooling the blanket gas 19 to a predetermined temperature.

In the preferred embodiment of the invention, the burners 16 are enclosed in a housing, generally 27, through which combustion air is fed by blower 28 and is consumed by the combustion process. The resulting combustion gas flow, controlled via computer actuated valves, is then fed to the retort shell 10 as blanket gas after being controlled to the blanket gas temperature and oxygen content specified by the NU-FUEL process, for the coal 13 being treated therein, by the heat exchanger 21 and oxygen monitoring device 33.

FIG. 2, a cross-sectional view taken generally along the line A—A of FIG. 1 illustrates the arrangement of the retort flights, specifically the alternation of long flights 10*a* and short flights 10*b*. This alternation provides for maximum space between the long flights 10*a* to allow occasional oversized pieces of coal to be processed. The long flights are so arranged that the larger size fractions are carried around the center pipe by the wiping action of the long flights and thus are returned to the heated bottom portion of the shell.

Further illustrated is the relationship of the longer flights 10*a* to the outer surface of the inside pipe (dimension X) which determines the split between the smaller pieces which fall directly to the bottom of the shell and the larger pieces which are carried over to the downward moving flights. The material of construction for the flights is of lighter gauge allowing for absorbed heat to radiate rapidly to the coal particles residing thereon.

The present invention has been described above in terms of specific embodiments which are representative of the invention. The particular examples described herein are merely illustrative of the invention, however, which is defined more generally by the following claims and their equivalents. While many objectives and advantages of the invention have been set forth, it is understood that the invention is defined by the scope of the following claims, not by the objectives and advantages.

I claim:

1. A horizontally inclined, rotary retort comprising: an inclined and axially rotating cylindrical shell, said shell having an inner surface an outer surface. and a rotatable pipe disposed inside said shell along the longitudinal axis of the shell; an inlet end box at one end of the shell for supplying raw coal as a material for treatment into the shell, said inlet end box equipped with a hopper bottom and a rotary air lock for removing fines entrained in a non-oxidizing blanket gas, said inlet end box also provided with a duct connection for removing the blanket gas and moisture from the raw coal being dried; said shell terminating in a discharge end box, said discharge end box equipped with a hopper bottom and a rotary air lock for removing processed material; said shell operably connected to and rotated by a motor-driven ring and pinion gear; the inside surface of said shell equipped with long and short flights alternating in a circumferential direction along said inside surface, said long and short flights having predetermined distances between individual flights to accommodate variably-sized pieces of coal being dried and treated.

2. The retort of claim 1 further comprising external heating means for heating the outside surface of said shell.

3. The retort of claim 2 further including a housing covering said heating means and extending around a portion of the outside surface of said shell.

4. The retort of claim 2 wherein the blanket gas comprises combustion gases generated by said heating means.

5. The retort of claim 1, wherein said rotatable pipe is provided with curved offset recesses on the exterior of the pipe and with thermocouples attached to said recesses for measuring the surface temperature of the coal during processing.

6. The retort of claim 5, wherein the pipe is provided with a means for rotating said center pipe some 90° to 120°, once for each revolution of the shell, in order to facilitate continuous movement of coal past said thermocouples and corresponding surface temperature measurement.

7. The retort of claim 1 further including a heat exchanger for regulating the temperature of said blanket gas, said heat exchanger operably connected to said discharge end box.

8. The retort of claim 1 further including an oxygen monitoring device operably connected to said retort for controlling the oxygen content of said blanket gas.

* * * * *